US007258623B2

(12) United States Patent
Halleck et al.

(10) Patent No.: US 7,258,623 B2
(45) **Date of Patent: *Aug. 21, 2007**

(54) METHOD AND APPARATUS FOR ATTACHING GOLF CLUB HEAD AND SHAFT

(75) Inventors: Brian Maurice Halleck, Santa Barbara, CA (US); Ryuichi Sugimae, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/264,297

(22) Filed: Oct. 31, 2005

(65) Prior Publication Data

US 2007/0099719 A1 May 3, 2007

(51) Int. Cl.
*A63B 53/04* (2006.01)

(52) U.S. Cl. ..... 473/308; 473/310

(58) Field of Classification Search ..... 473/308–310
See application file for complete search history.

(56) References Cited

U.S. PATENT DOCUMENTS

| | | | | |
|---|---|---|---|---|
| 1,487,707 | A | 3/1924 | Benton | |
| 1,540,559 | A | 6/1925 | Murphy | |
| 1,844,812 | A * | 2/1932 | Thorpe | 473/308 |
| 1,976,324 | A | 10/1934 | Burhke et al. | |
| 1,980,408 | A * | 11/1934 | Jansky | 473/310 |
| 1,997,889 | A | 4/1935 | Smith | |
| 2,015,253 | A | 9/1935 | Buhrke et al. | |
| 2,016,218 | A * | 10/1935 | Stephens | 473/310 |
| 2,282,614 | A | 5/1942 | Smith | |
| 3,572,709 | A * | 3/1971 | Risher | 473/308 |
| 5,009,423 | A * | 4/1991 | Okumoto et al. | 473/308 |
| 5,624,330 | A * | 4/1997 | Tsuchida | 473/308 |
| 5,711,721 | A | 1/1998 | Johnson et al. | |
| 5,797,806 | A * | 8/1998 | Butler | 473/310 |
| 5,863,260 | A | 1/1999 | Butler, Jr. et al. | |
| 5,910,056 | A | 6/1999 | Nagamoto et al. | |
| 6,352,482 | B1 | 3/2002 | Jacobsen et al. | |
| 6,692,375 | B2 | 2/2004 | Abe | |
| 2005/0101401 | A1 * | 5/2005 | Sugimae et al. | 473/305 |

FOREIGN PATENT DOCUMENTS

| | | |
|---|---|---|
| JP | 9075484 | 3/1997 |
| JP | 2000042146 | 2/2000 |
| JP | 2003093551 | 2/2003 |

OTHER PUBLICATIONS

The Bohning Company, Ltd., Golf Ferrule Division, "Tech Tips," http://www.bohning.com/golf/techtips.html, 3 pages, May 23, 2005.
Golf-R-Way, "Golf Club Assembly," http://www.golfrway.com/support/assembly.asp, 2 pages, May 23, 2005.

* cited by examiner

*Primary Examiner*—Stephen Blau
(74) *Attorney, Agent, or Firm*—Klarquist Sparkman, LLP

(57) ABSTRACT

A golf club shaft is attached to a club head hosel by a ferrule system including a ferrule mating member and a ferrule sleeve. The mating member includes an enlarged portion on which the second ferrule is seated and a reduced portion which is seated within the club head hosel. The mating member overlaps axially with the ferrule sleeve and hosel to support the shaft extending therethrough. The reduced portion seats within a recessed annular portion of the hosel and includes radially outwardly extending projections which define flow channels therebetween through which adhesive may flow during assembly.

4 Claims, 2 Drawing Sheets

METHOD AND APPARATUS FOR ATTACHING GOLF CLUB HEAD AND SHAFT

BACKGROUND OF THE INVENTION

The present invention relates generally to golf clubs and, more particularly, to a ferrule system to facilitate the connection between a golf club head and shaft and method for making a golf club.

Golf clubs have a club head which is mounted to a golf club shaft. Club heads typically include a cylindrical hosel portion that defines an opening to receive one end of the shaft. To eliminate a "step" or abrupt change in the outer surface where the hosel and shaft end meet, golf clubs typically are provided with a frusto-conical ferrule to provide an aesthetic appearance at the hosel-shaft juncture. Conventional ferrules, which are press fit or adhered to the club shaft and hosel and abut the hosel end to end, are designed to have a maximum outer diameter corresponding to the outer diameter of the hosel to provide a smooth transition from the hosel to the ferrule.

In a more recent modification of the foregoing ferrule construction used by at least one golf club manufacturer, an outer surface of the hosel is cast and ground to provide an undulating surface and step to receive the ferrule in overlapping relationship. The hosel step provides a stop against which the end of the ferrule abuts. The undulating surface creates a better fit between the hosel and ferrule. As before, the maximum outer diameter of the ferrule at the end abutting the hosel is the same as the outer diameter of the hosel at the ferrule-hosel juncture to provide (at least in theory) a seamless outer surface transition between the hosel and ferrule.

One drawback of the foregoing design is that it often requires an additional labor-intensive grinding step. The additional step is necessary because of the difficulty of casting fine features, such as the undulations, to meet manufacturing tolerances sufficient to create a good fit between the ferrule and hosel. Without a grinding step, the fit may be so tight as to distort or damage the ferrule if it is forced onto the hosel. Alternatively, if the hosel is cast or ground to have an outer diameter that conservatively is too small, the ferrule and hosel may have an unacceptably loose fit. Another drawback is that the hosel, once ground, is configured to fit only ferrules having a complimentary configuration and size. As so constructed, a golf club technician can replace the ferrule or shaft only if (s)he has a replacement ferrule designed to fit the hosel of the club head. As a practical matter, golf club technicians often grind off the ferrule receiving portion of the hosel so that the hosel will accept a standard ferrule which the technician happens to have on hand.

It should be appreciated that there exists a need for a golf club ferrule system and manufacturing method that allows a golf club to be manufactured more efficiently and less expensively, and to be repaired and rebuilt more easily.

SUMMARY OF THE INVENTION

Disclosed below are representative embodiments that are not intended to be limiting in any way. Instead, the present disclosure is directed toward novel and nonobvious features, aspects and equivalents of the embodiments of the golf club ferrule system and method of making and assembling a golf club described below. The disclosed features and aspects of the embodiments can be used alone or in various novel and nonobvious combinations and sub-combinations with one another.

Briefly, and in general terms, the present application describes a multi-piece ferrule system in which a first ferrule member coupled to a golf club head hosel serves as an extension of the hosel, preferably a male extension member, to receive and seat a second ferrule member, preferably a female sleeve member. The hosel, first ferrule member and second ferrule member each have bores which are axially aligned to receive and support a golf club shaft. The first ferrule member preferably is an intermediate member that axially overlaps with both the hosel and second ferrule member to provide a stable joint at the shaft-hosel interface. The visible portions of the ferrule system are shaped and contoured to provide an aesthetically pleasing, virtually seamless transition between the hosel and ferrule.

According to another aspect of the invention, a golf club is constructed by securing the first ferrule member to the golf club hosel by, for example, press fit interconnection, adhesion and preferably both. One end of the golf club shaft is loosely fitted with the second ferrule member. The shaft end is inserted into and secured to the hosel, preferably by adhering the shaft end to the hosel. The second ferrule member is moved along the shaft, coupled to the first ferrule member, preferably in end-to-end abutment with the hosel, and secured to the hosel and first ferrule member.

According to another aspect of the invention, the first and second ferrule members preferably are made of an injection moldable compliant material, such as an elastomer. The material should be durable and compliant enough to withstand the impact forces to which a golf club is subject, without cracking or otherwise failing.

The foregoing and other objects, features, and advantages of the invention will become more apparent from the following detailed description, which proceeds with reference to the accompanying figures.

DETAILED DESCRIPTION OF EXEMPLARY EMBODIMENTS

Figure 1:
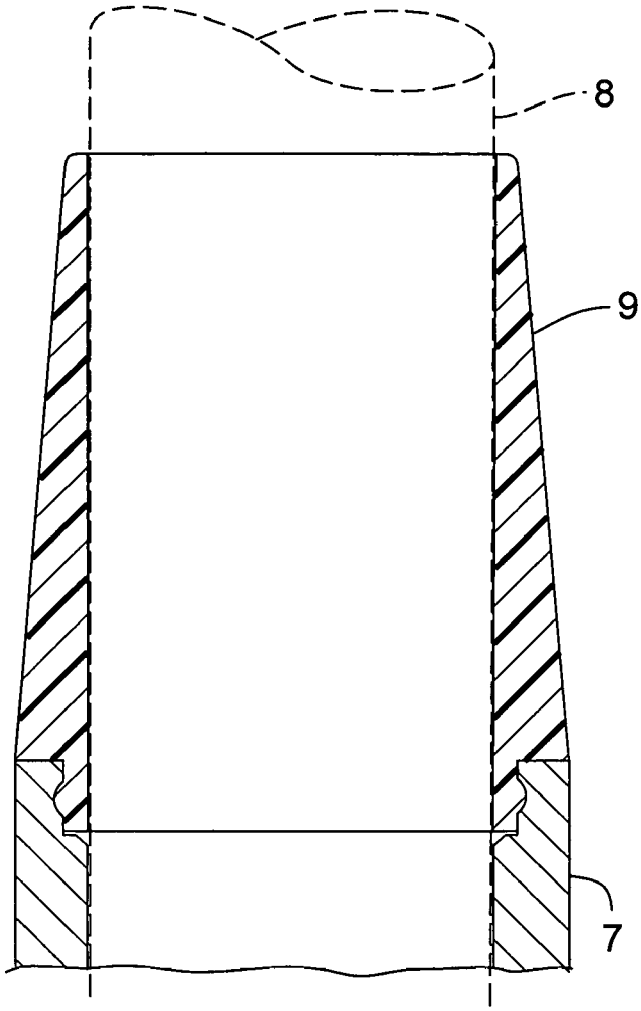
FIG. 1 (Prior Art)
FIG. 1 is a cross-sectional view of a prior art golf club construction including a golf club head, shaft and ferrule.

By way of background, FIG. 1 shows a prior art golf club construction for making a golf club having a hosel 7, club shaft 8 and ferrule 9. The hosel is cast as an integral extension of a ball striking portion (not shown) of a golf club head. The hosel is cast to have an end portion with a reduced diameter and raised annular ring and, if necessary, ground to create an overlapping fit for the ferrule 9.

During assembly, the ferrule 9 is loosely fit onto the end of the shaft 8 and the hosel filled with glue. The shaft end is inserted into the hosel and the ferrule moved into snap fit engagement on the end of the hosel. Once the glue cures, the shaft and ferrule are adhered to the hosel.

Figure 2:
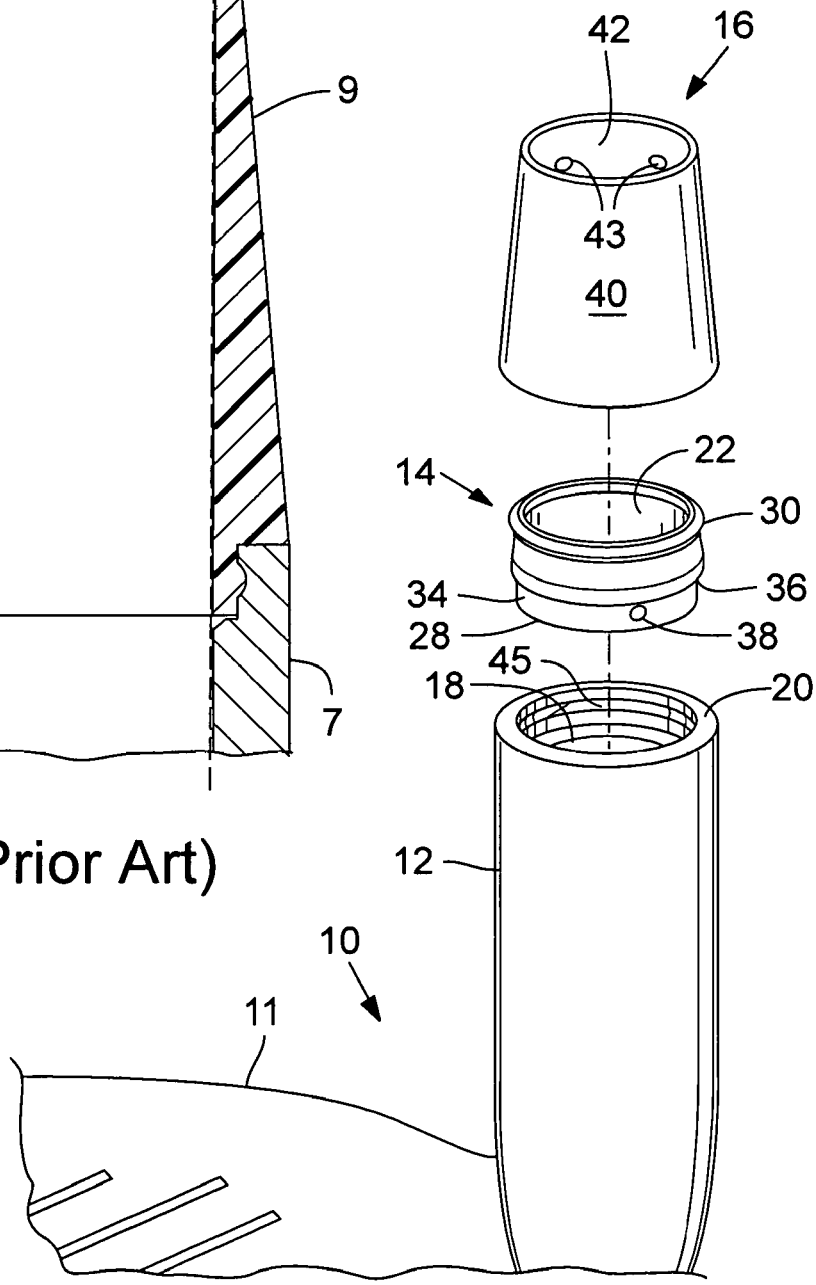
FIG. 2 is an exploded perspective view of a golf club in accordance with the present invention, depicting a club head having a hosel portion and a ferrule for connecting the club head to the shaft.

With reference to the illustrative drawings, and particularly FIG. 2, an exemplary embodiment of the present invention includes a golf club head 10 having a ball striking portion 11 and hosel 12 extending from the ball striking portion, ferrule mating member 14 and ferrule sleeve 16. The hosel, ferrule mating member and ferrule sleeve serve to facilitate the connection of the golf club shaft (not shown) to the club head so as to provide a smooth aesthetically pleasing connection between the club head and shaft.

The club head 10, including the hosel, may be formed by casting, forging, grinding, welding and/or other manufacturing techniques for creating an integral structure. The hosel and ball striking portion of the club head also may be formed separately and joined together by welding or otherwise to create an integral structure. Presently, most if not all club heads are made of metal but other materials, such as composites and wood, suitable for striking a golf ball may be used. The hosel 12 preferably is generally cylindrical and has a centered bore, defined by a bore wall 18, sized to receive an end portion of the golf club shaft. The hosel terminates at an end wall 20 which defines an opening at the entrance of the centered bore.

Figure 3:
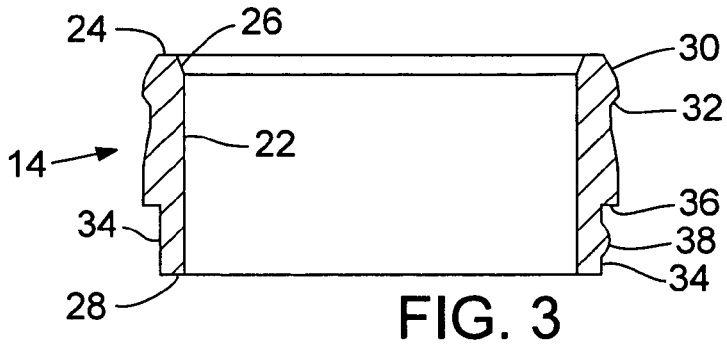
FIG. 3 is a cross-sectional view of one element of the ferrule, taken along line 3-3 of FIG. 4.
Figure 4:
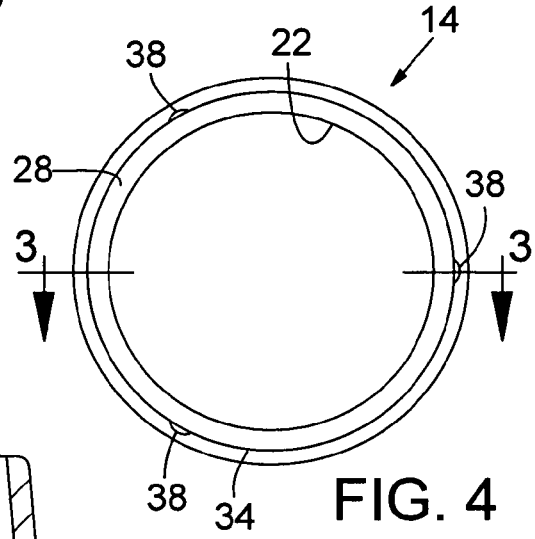
FIG. 4 is a bottom end view of one element of the ferrule shown in FIG. 2.
Figure 5:
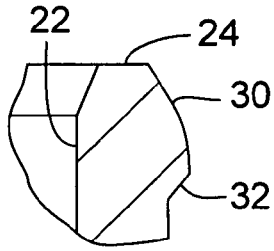
FIG. 5 is an enlarged partial cross-sectional view depicting an end portion of the ferrule element of FIG. 3.

The hosel opening receives and seats the ferrule mating member 14. As shown in FIGS. 3 and 4, the ferrule mating member preferably has a generally cylindrical or annular ring-like shape to permit the golf club shaft to extend therethrough. The ferrule mating member includes a bore wall 22 terminating at a first end wall 24 and at an opposite second end wall 28. The end wall 24 preferably has a beveled opening 26 to permit the golf club shaft to be inserted easily therethrough. The bore wall 22 has a diameter, typically within the range of about 8.5 to 10 mm, that is slightly greater than the outer diameter of the golf club shaft extending therethrough. For example, the bore wall diameter for an iron may be about 9.6 mm, with the diameter for a wood typically being smaller. The ferrule mating member also preferably includes an outer surface having a chamfered edge 30 (FIGS. 3 and 5) adjacent to the end wall 24, lip 32 (FIGS. 3 and 5) adjacent the chamfered edge, and hosel engaging outer wall 34. The hosel engaging outer wall preferably has an outer diameter which is less than the remaining outer surface of the mating member, creating a step 36. Thus, the chamfered edge 30, lip 32 and adjacent outer wall surface generally is enlarged, with a larger outer diameter, relative to the hosel engaging outer wall 34. The hosel engaging outer wall preferably is provided with a plurality of raised bumps 38 or other projections, such as ribs, to engage the bore wall of the hosel. In the illustrative embodiment (see FIG. 4), three raised projections spaced are provided around the hosel engaging wall 34.

Figure 6:
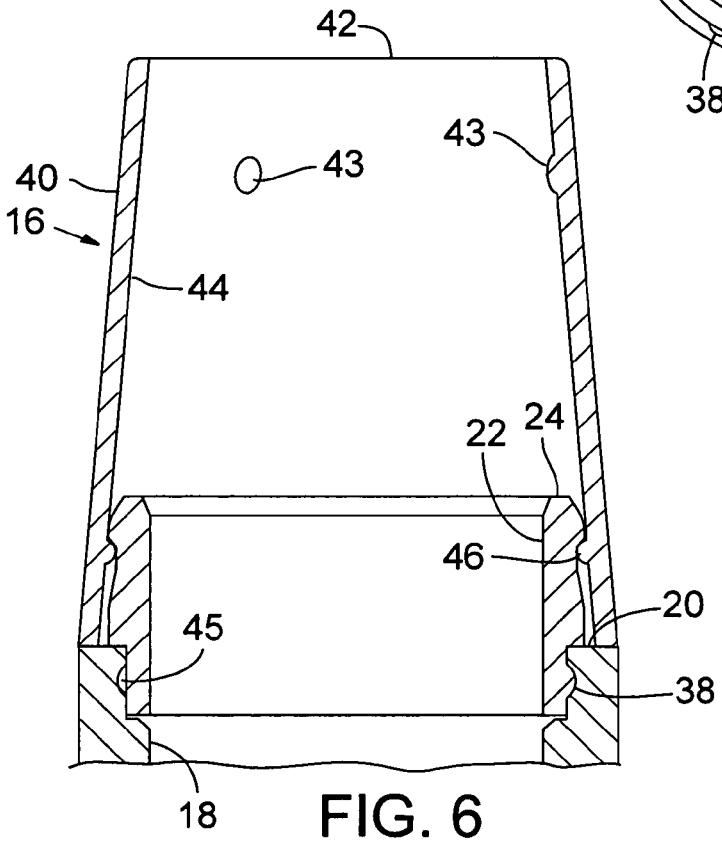
FIG. 6 is a cross-sectional view of the present invention in an assembled condition.

With reference to FIGS. 2 and 6, the ferrule sleeve 16 preferably has a frusto-conical shape and includes an outer surface 40, opening 42 and bore wall 44. The diameter of the outer surface tapers slightly from a maximum outer diameter at one end adjacent the hosel to a minimum outer diameter at the opposite end proximate to the opening 42. Similarly, in one embodiment the bore wall 44 has an inner diameter that tapers slightly from a maximum diameter at the end adjacent the hosel to a minimum diameter at the opposite end away from the hosel. Alternatively, the ferrule sleeve may have a variable wall thickness and a generally constant inner diameter. Bore wall 44 preferably is provided with a plurality of internal projections 43 spaced apart circumferentially on the bore wall to engage and center the club shaft within the ferrule sleeve and facilitate centering the club shaft within the hosel. In the exemplary embodiment shown, the sleeve has three internal projections angularly spaced about 120° from one another.

As shown in FIG. 6, although the ferrule mating member 14 and ferrule sleeve 16 may be considered a two-piece ferrule construction, the mating member in some ways serves as a hosel extension to couple the hosel to a ferrule member, such as ferrule sleeve 16. The mating member can have many different profiles and shapes to suit desired functional objectives so long as it cooperates with the ferrule sleeve to provide a stable connection therebetween and preferably an interface surface suitable to receive an adhesive to create an even stronger connection, bond, or coupling between the ferrule sleeve and mating member.

In the illustrated embodiment, the end of the hosel is provided with an annular recess 45 (FIG. 2) having an inner diameter slightly greater than the outer diameter of the hosel engaging wall 34 to securely seat the mating member within the hosel. The raised bumps 38 formed in the hosel engaging outer wall 34 facilitate a tighter, more secure frictional engagement between the mating member and hosel, while allowing the mating member to be easily seated in the open end of the hosel. The bumps also serve to help center the mating member and facilitate the flow of adhesive between the hosel and mating member during assembly.

As shown in FIG. 6, the maximum inner diameter of the ferrule sleeve preferably is slightly less than the outer diameter of the enlarged portion of the mating member, allowing the ferrule sleeve to be snap fit on the mating member with one end wall of the sleeve in abutting contact with the end wall 20 of the hosel. In this way, a smooth, virtually seamless, aesthetically pleasing outer surface is provided at the juncture between the hosel and ferrule sleeve. The sleeve's bore wall 44 may be provided with a raised annular ring 46 adjacent the mating member to engage an annular recess formed in the mating member adjacent the lip 32. In this way, the ferrule sleeve may be more securely coupled to the mating member in a snap-fit like fashion. Alternatively, ribs or other known fitting techniques may be used to provide a secure coupling between the mating member and ferrule sleeve, or these components may be coupled together strictly by frictional engagement between the two.

The mating member and ferrule sleeve preferably are made of a non-metal material and, most preferably, a material that is injection moldable and exhibits some degree of compliability to allow the mating member to seat easily within the hosel and the sleeve to seat easily on the mating member, even when the dimensions of the molded parts do not perfectly match manufacturing specifications. Suitable materials include injection moldable elastomers, such as nylon, polyester, polypropylene, polyolefin, polyethylene, polyamide and the like. The material should be durable and compliant enough to withstand impact forces to which golf clubs are subject without cracking or otherwise failing.

It will be appreciated that the physical construction of the hosel, ferrule sleeve and mating member facilitates a relatively strong and stable joint for coupling the club shaft to the club head by aligning the shaft more concentrically within the hosel and providing a more uniform layer of adhesive. Equally important, a smooth and aesthetic transition seam is provided at the juncture where the club shaft is attached to the hosel.

During manufacturing, an adhesive, such as an acrylic-based adhesive, is applied to the hosel engaging wall 34, recessed portion of the hosel adjacent the hosel opening or both, and the mating member seated within and adhered to the hosel. Other suitable adhesives, such as epoxy, may be used. Next, adhesive is injected into the open end of the joined mating member and hosel to provide a reservoir of adhesive in the shaft receiving bore of the hosel. The ferrule sleeve then is slid onto the "tip" end of the club shaft. With the sleeve loosely carried by the club shaft, the shaft's tip end is inserted through the mating member and into the shaft receiving bore 18 of the hosel. The mating member's beveled opening 26 facilitates the insertion of the shaft's tip end through the mating member and into the hosel. As the shaft displaces flowable adhesive residing in the hosel, some adhesive oozes up and around the mating member, providing adhesive on bore wall 22 of the hosel and around the enlarged outer wall of the mating member. This allows the ferrule sleeve to be adhered to the mating member by sliding the ferrule sleeve down the club shaft into seated engagement on the mating member, with the sleeve's "hosel" end in abutment with the hosel end wall 20.

Adhesive on the club shaft allows the ferrule sleeve to be adhered to the shaft. Excess adhesive is wiped off and the adhesive bond between the shaft, hosel, mating member and ferrule sleeve allowed to cure in a conventional manner.

It will be appreciated that the foregoing exemplary construction has features which offer several advantages which may be incorporated into a golf club construction, individually or in combination. The manufacturing process for the club head is simplified and made more economical. The hosel's shaft receiving opening can be used largely "as is" without the need to grind or machine the outer surface of the hosel to provide a proper fit for the ferrule. Production yield is improved because it is easier to make the "male" ferrule mating member to target manufacturing specifications and tolerances using injection molding techniques than it is using metal casting techniques. Also, by using an injection molded male ferrule component (mating member) rather than a custom cast and machined hosel end, the hosel has a standard ferrule-receiving profile that can be used with many standard ferrule constructions (without requiring a mating member such as mating member 14). This allows "after market" golf club technicians to more easily repair, rebuild or reconfigure golf clubs using standard off-the-shelf ferrules. In addition, the present invention lends itself well for use with forged as well as cast club heads by eliminating the need to machine the outer surface of the hosel.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A golf club comprising:

a golf club head having a hosel and shaft receiving opening in the hosel;

a shaft having a lower end extending through the shaft receiving opening into the hosel;

a first ferrule element having a first bore wall generally in axial alignment with the shaft receiving opening, and a first outer wall; and a second ferrule element having a second bore wall generally in axial alignment with the shaft receiving opening, and a second outer wall, wherein the second ferrule element does not axially overlap the hosel;

the first outer wall having an enlarged portion sized to axially engage at least a portion of the second bore wall to create a contact fit therebetween, wherein the second bore wall axially overlaps the first outer wall, and having a hosel engaging portion sized to engage the shaft receiving opening of the hosel;

the lower end of the shaft being in coaxial alignment with the hosel, first ferrule element and second ferrule element;

the hosel having a third bore wall that is enlarged proximate the shaft receiving opening to receive the hosel engaging portion of the first ferrule element;

the hosel engaging portion including plural raised projections spaced about a periphery of the hosel engaging portion;

the raised projections defining channels therebetween adapted to receive a viscous material.

2. A golf club comprising:

a club head having a hosel defining a shaft receiving bore;

a club shaft having one end located within the shaft receiving bore;

a first ferrule member axially aligned with the shaft receiving bore and secured to the hosel, the first ferrule member extending from the hosel and residing in coaxial relationship with the club shaft; and a second ferrule member coupled to the first ferrule member, the second ferrule member residing in coaxial relationship with the club shaft and first ferrule member and not overlapping the hosel;

the first and second ferrule members cooperating to support the club shaft and provide a substantially seamless outer surface transition between the hosel and second ferrule member;

the shaft receiving bore having an enlarged inner wall portion compatibly sized to receive the first ferrule member;

the first ferrule member having an outer hosel engaging wall portion in coaxial relationship with the shaft receiving bore, the hosel engaging wall portion having a plurality of projections in contact with the shaft receiving bore, the projections being substantially circumferentially spaced from one another to provide flow channels between the hosel and first ferrule member.

3. A golf club comprising:

a club head having a hosel defining a shaft receiving bore;

a club shaft having one end located within the shaft receiving bore;

a first ferrule member axially aligned with the shaft receiving bore and secured to the hosel, the first ferrule member extending from the hosel and residing in coaxial relationship with the club shaft; and a second ferrule member coupled to the first ferrule member, the second ferrule member residing in coaxial relationship with the club shaft and first ferrule member and not overlapping the hosel;

the first and second ferrule members cooperating to support the club shaft and provide a substantially seamless outer surface transition between the hosel and second ferrule member;

the shaft receiving bore having an enlarged inner wall portion compatibly sized to receive the first ferrule member;

the first ferrule member including an annular surface portion and a plurality of outer projections extending from and spaced circumferentially around the annular surface portion, the projections contacting the shaft receiving bore and providing channels adapted to receive an adhesive.

4. A golf club comprising:

a club head having a hosel defining a shaft receiving bore;

a club shaft having one end located within the shaft receiving bore;

a first ferrule member axially aligned with the shaft receiving bore and secured to the hosel, the first ferrule member extending from the hosel and residing in coaxial relationship with the club shaft; and a second ferrule member coupled to the first ferrule member, the second ferrule member residing in coaxial relationship with the club shaft and first ferrule member and not overlapping the hosel;

the first and second ferrule members cooperating to support the club shaft and provide a substantially seamless outer surface transition between the hosel and second ferrule member;

the shaft receiving bore having an enlarged inner wall portion compatibly sized to receive the first ferrule member;

the second ferrule member including a plurality of spaced apart internal projections extending inwardly, the internal projections engaging the club shaft to help center the club shaft with respect to the hosel.

* * * * *